US007293675B1

(12) United States Patent
Luhn

(10) Patent No.: US 7,293,675 B1
(45) Date of Patent: Nov. 13, 2007

(54) BEVERAGE LINE CLEANING SYSTEM

(75) Inventor: Noel G. Luhn, Springboro, OH (US)

(73) Assignee: VeryFresh Juice Company, Inc., Dayton, OH (US)

( * ) Notice: Subject to any disclaimer, the term of this patent is extended or adjusted under 35 U.S.C. 154(b) by 588 days.

(21) Appl. No.: 10/858,099

(22) Filed: Jun. 1, 2004

(51) Int. Cl.
*B67D 5/08* (2006.01)

(52) U.S. Cl. ..... 222/148; 222/94; 222/105; 222/132; 222/135; 137/238

(58) Field of Classification Search ..... 222/1, 222/148, 94, 105, 129.1, 135, 130–132; 137/599.03, 137/266, 263, 238, 240
See application file for complete search history.

(56) References Cited

U.S. PATENT DOCUMENTS 494,061 A * 3/1893 Day ..... 137/12.5
3,036,741 A * 5/1962 Hilts ..... 222/148
3,790,029 A * 2/1974 Ward ..... 222/129.4
4,375,864 A * 3/1983 Savage ..... 222/81
4,421,146 A 12/1983 Bond et al.
4,572,230 A * 2/1986 Mirabile ..... 137/240
4,582,226 A * 4/1986 Doak ..... 222/148
4,606,476 A * 8/1986 Pocock et al. ..... 222/148
4,615,466 A 10/1986 Credle, Jr.
4,753,372 A * 6/1988 Pocock et al. ..... 222/148
4,796,788 A 1/1989 Bond
4,801,048 A 1/1989 Credle, Jr. et al.
4,886,190 A * 12/1989 Kirschner et al. ..... 222/57
4,941,593 A * 7/1990 Hicks et al. ..... 222/148
5,090,440 A * 2/1992 Ladouceur et al. ..... 137/209
5,115,943 A * 5/1992 Coleman ..... 222/94
5,537,838 A 7/1996 Mills et al.
6,684,920 B2 2/2004 Seitz et al.

* cited by examiner

*Primary Examiner*—Frederick C. Nicolas
(74) *Attorney, Agent, or Firm*—Jacox, Meckstroth & Jenkins

(57) ABSTRACT

Concentrated beverages are supplied from corresponding collapsible bags-in-boxes to a fountain dispenser having multiple dispensing valves and through corresponding beverage supply lines each having an air operated pump. A coupler connects each supply line to a spout on the corresponding beverage bag, and each spout and coupler has a normally closed spring-biased valve. Each beverage supply line is cleaned by a cleaning solution confined within a bag-in-a-box and having a spout connected by another coupler to one end portion of a cleaning solution line having a second end portion with an adapter connected to the coupler on the beverage supply line. A manifold has an inlet connected to the first end portion of the cleaning solution line and multiple outlets with shut-off valves connected to second end portions of corresponding cleaning solution lines so that multiple beverage supply lines to a dispenser may be cleaned simultaneously.

7 Claims, 2 Drawing Sheets

BEVERAGE LINE CLEANING SYSTEM

BACKGROUND OF THE INVENTION

This invention relates to the supply of various non-alcoholic beverages to fountain dispensers, for example, of the general type disclosed in U.S. Pat. No. 4,615,466, No. 4,801,048, No. 5,537,838, and No. 6,684,920, the disclosures of which are herein incorporated by reference. In such supply, it is common to have each beverage supplied in a collapsible bag within a box, such as a fiberboard box, which is located remotely from the dispenser and commonly referred to as bag-in-box (BIB) packaging as disclosed, for example in U.S. Pat. No. 4,796,788. The various beverages include various syrups, juices, fruit drinks and teas, and usually the beverages are concentrated and mixed with water within the fountain dispenser which provides for selectively dispensing the multiple different beverages, for example, up to eight different beverages.

The beverage bags within boxes are normally provided with each bag having a spout with a normally closed valve and which is recessed within the bag during shipping and handling of the box. The spout is pulled outwardly to a projecting position after the box is located at the dispensing location or within a rack which holds multiple boxes each enclosing a collapsible bag containing a beverage. The beverage within each collapsible bag is usually supplied to the fountain dispenser through a beverage supply conduit or line including clear flexible plastic tubing, air driven pump and a coupling on the end which removably attaches to the projecting spout on the bag. The coupler has a normally closed valve, and the coupler valve and the valve within the spout are shifted to open positions when the coupler attaches to the spout, for example, as disclosed in U.S. Pat. No. 4,421,146, the disclosure of which is herein incorporated by reference. This patent discloses a quick-connect and quick-disconnect coupler or connector for connecting the beverage supply line to a bag within a box. However, the spout and coupler may have other forms, for example, a coupler having a normally closed valve and internal threads which threadably connects to a bag spout having a normally closed valve and external threads.

After a beverage has been pumped from a beverage supply bag through the beverage supply line to the fountain dispenser for a period of time or when a beverage bag has been emptied, it is desirable and sometimes necessary to clean the beverage supply line including the corresponding supply pump and dispensing valve within the fountain dispenser in order to avoid a buildup of beverage residue within the supply line and/or to supply a different beverage through the supply line. Commonly, a supply line is cleaned by mixing a liquid chlorine based solution in an open bucket at a recommended ratio. The coupler on the supply line is removed from the spout on the bag, and the coupler and the attached end portion of the supply line are dropped into the bucket. When the dispensing valve on the dispenser is manually opened, the cleaning solution is sucked out of the bucket by the pump and forced through the supply line and through the dispensing valve.

After the chlorine based solution is pumped through the beverage supply line and out the dispensing valve for a predetermined time, the coupler end of the supply line is placed in a bucket of potable water, and the water is pumped through the supply line to displace the chlorine base solution. The coupler is then attached to the spout on a new beverage bag, and the new beverage is pumped through the beverage supply line to displace the water. After all of the water is displaced, the dispensing valve on the fountain dispenser is closed. However, it has been found difficult to obtain and maintain a proper mix ratio of the cleaning solution within the bucket, especially when the solution in the bucket is used to clean multiple beverage supply lines to the dispenser. Also the open bucket is subject to picking up external contaminants.

SUMMARY OF THE INVENTION

The present invention is directed to an improved system and method for cleaning one or more beverage supply lines extending from a collapsible beverage bag enclosed within a box to a beverage dispenser having a dispensing valve. The system and method of the invention assures a proper predetermined mixture of the cleaning solution and also assures sanitation of the cleaning solution as well as sanitation of each beverage supply line during cleaning. The system also permits one person to clean only one line at a time or to clean multiple lines simultaneously and without requiring that any of the lines be flushed with pure clear water after the cleaning solution is pumped through the supply line.

In accordance with one embodiment of the invention, a collapsible bag is filled with a predetermined and properly mixed cleaning solution, and the bag is provided with a spout of the same type as commonly used on a beverage supply bag. The bag is enclosed within a box of the same size as the beverage supply box so that the box enclosing the bag containing the cleaning solution may be placed on the same rack which supports a plurality of boxes containing beverage supply bags. The cleaning system of the invention also includes a cleaning solution supply line having a first end section or portion connected to a coupler of the same type connected to the beverage supply line and having a normally closed internal valve. The cleaning solution supply line has an opposite end section or portion connected to an adapter which connects with the coupler on the end of a beverage supply line.

When it is desired to clean a beverage supply line including the coupler, flexible tubing, supply pump and dispensing valve on the fountain dispenser, the coupler on the beverage supply line is removed from the spout on the beverage supply bag and connected to the adapter on the cleaning solution supply line. The coupler on the opposite end of the cleaning solution supply line is connected to the spout on the collapsible bag containing the premixed cleaning solution. When the coupler is attached or connected to the adapter and to the spout on the cleaning solution bag, all of the internal valves automatically open, and the cleaning solution is free to flow from the collapsible bag through the cleaning solution supply line when the dispensing valve on the dispenser is opened and the pump is activated.

Preferably, the cleaning solution within the collapsible bag is a clear product so that when the clear cleaning solution flows from the dispensing valve, a visually indication is provided that the beverage supply line has been cleaned. The cleaning system of the invention also provides a manifold having an inlet connected to the first portion of the cleaning solution supply line and a plurality of outlets each having an on-off valve and connected to corresponding second portions of multiple cleaning solution supply lines. As illustrated, the manifold has eight outlets with separate on-off valves, and each second portion of the cleaning solution supply line is connected to a corresponding adapter so that multiple beverage supply lines may be cleaned in succession or simultaneously by one person standing at the fountain dispenser and selectively operating the valves on the dispenser.

Other features and advantages of the invention will be apparent from the following description, the accompanying drawings and the appended claims.

DESCRIPTION OF THE PREFERRED EMBODIMENT

Figure 1:
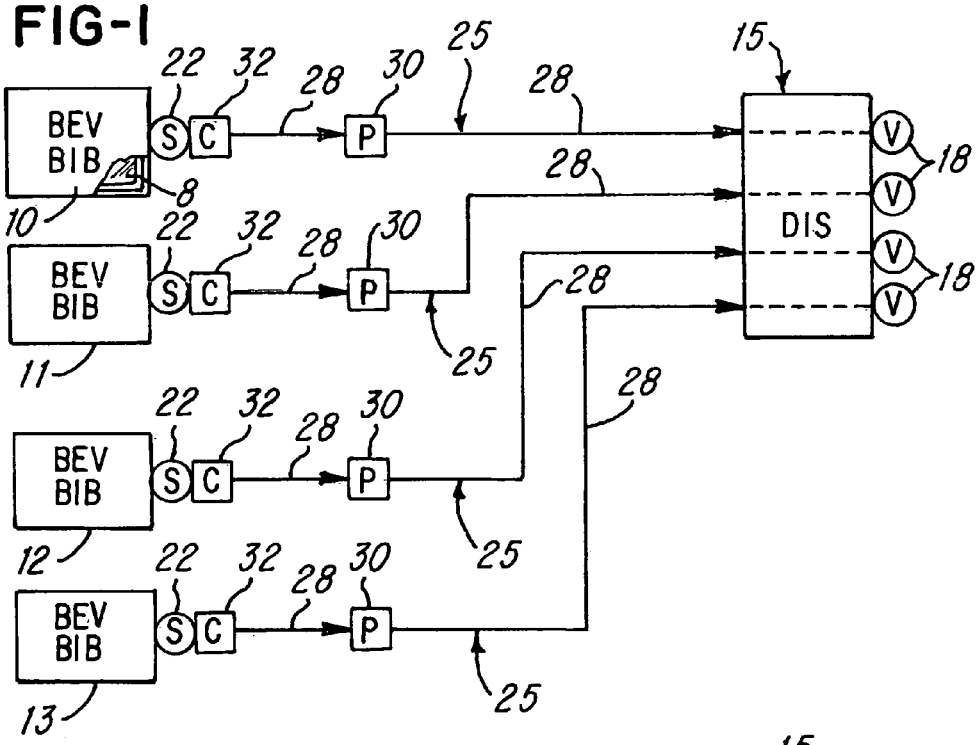
FIG. 1 is a diagrammatic illustration of a conventional system for supplying four different BIB beverages through corresponding beverage supply lines to a fountain beverage dispenser having four corresponding manually actuated dispensing valves.

FIG. 1 illustrates diagrammatically a series of four different beverages each contained within a collapsible plastic bag 8, and the bags are enclosed within boxes 10, 11, 12 and 13 which are usually folded paperboard boxes. While four different beverages (BEV) are shown in corresponding bag-in-boxes (BIB), it is to be understood that more or less beverages within BIBs may be used for supplying beverages to a remote fountain type beverage dispenser 15, for example, of the general type disclosed in the above-mentioned patents. The beverage dispenser 15 has a normally closed dispensing valve 18 for each of the beverages being supplied, and the opening of the valves may be mechanically or electrically controlled. Each of the bags 8 within the boxes 10-13 has an attached tubular spout 22 having a normally closed spring-biased valve, and the spout is retracted within the bag 8 and box during handling and shipping of the box. When each box arrives at its destination, a section of the box is removed to form an opening, and the spout is pulled outwardly from the box through the opening where the spout is retained by the box.

The beverage within each collapsible bag 8 is supplied to the beverage dispenser 15 and corresponding dispensing valve 18 by a beverage supply line 25 which commonly includes clear flexible plastic tubing 28, an air driven pump 30 and a coupler 32 which connects with the spout 22 attached to the corresponding collapsible bag 8. The coupler 32 includes a normally closed valve, and a commonly used bag attached spout 22 and coupler 32 is disclosed in U.S. Pat. No. 4,421,146, the disclosure of which is herein incorporated by reference. As shown in this patent, when the quick-connect and quick-disconnect coupler 32 is connected to the corresponding spout 22, both of the normally closed valves within the spout 22 and coupler 32 are shifted to their and coupler 32 are shifted to their open positions so that the beverage within the bag may flow freely to the inlet of the pump 30 which delivers the beverage to the beverage dispenser 15. As mentioned above, the spout 22 and coupler 32, with internal normally closed valves, may have other forms, such as a coupler which is connected to a spout by external threads on the spout and internal threads on the coupler.

Figure 2:
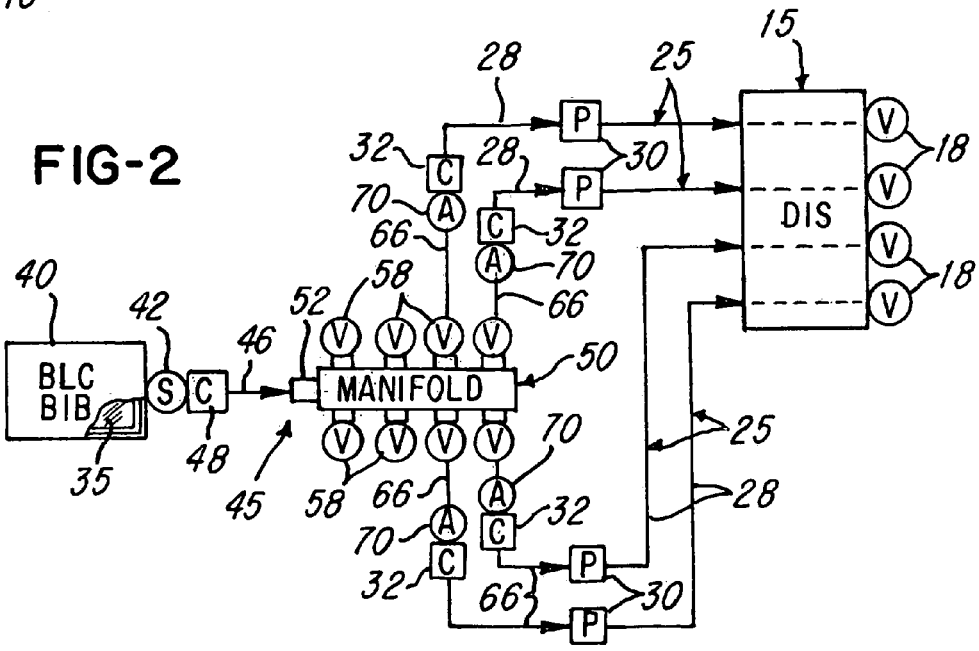
FIG. 2 is a diagrammatic illustration of a cleaning system constructed in accordance with the invention for selectively cleaning the beverage supply lines shown in the beverage supply system of FIG. 1.

In accordance with the present invention and as shown in FIG. 2, when it is desired to clean one or more of the beverage supply lines 25 due to a change in beverage or a deposit of beverage material or residue within the supply line, a colorless or clear cleaning solution is packaged within a collapsible bag 35 within a box 40. The bag 35 and box 40 preferably have the same construction as the collapsible bag 8 and box 10 referred to above in connection with FIG. 1. A preferred cleaning solution of predetermined mixture is available from Manitowoc Beverage Systems, Inc. in Holland, Ohio and sold under the trademark BEVCLEAN. The bag 35 containing the cleaning solution has an attached spout 42 with an internal valve, and the cleaning solution is supplied to each of the beverage supply lines 25 through a cleaning solution supply line 45. The line 45 includes a first end portion 46 preferably in the form of a flexible clear tube and having an attached coupler 48 with a normally closed internal valve. The spout 42 and coupler 48 may have the same construction as the spout 22 and the coupler 32 referred to above in connection with FIG. 1 and disclosed in above-mentioned U.S. Pat. No. 4,421,146. The spout and coupler may also be in another form, for example, the thread connecting spout and coupler as mentioned above.

Figure 3:
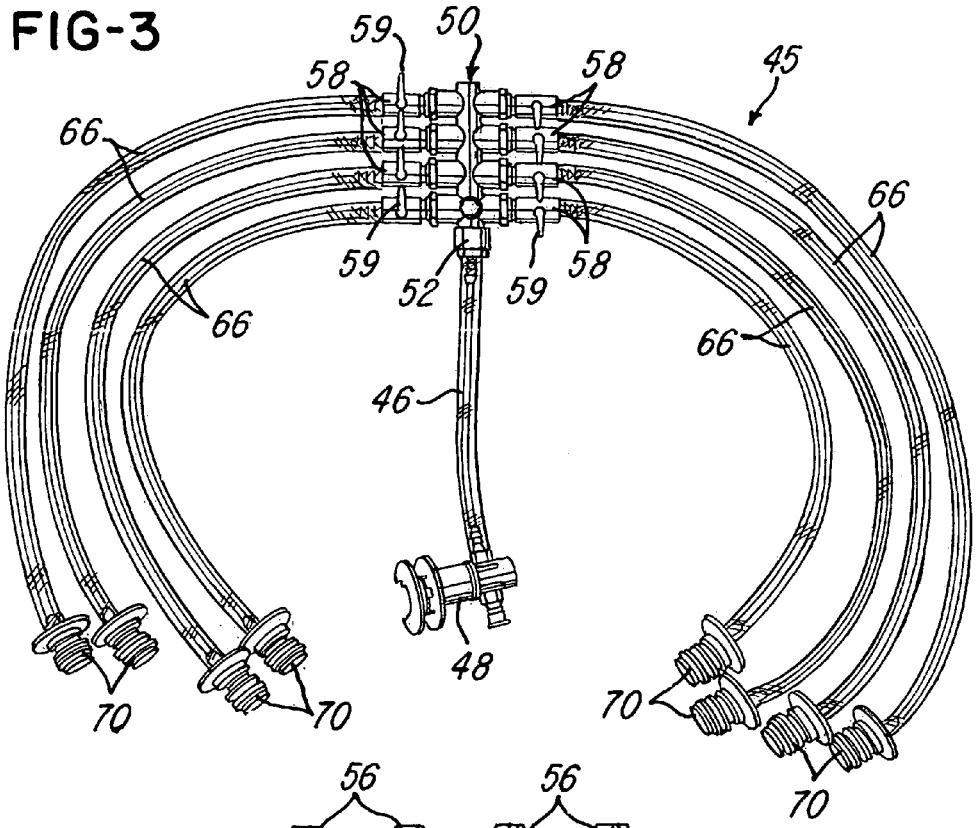
FIG. 3 is a perspective illustration of a manifold with shut-off valves and clear plastic cleaning solution supply lines and constructed in accordance with the invention.
Figure 4:
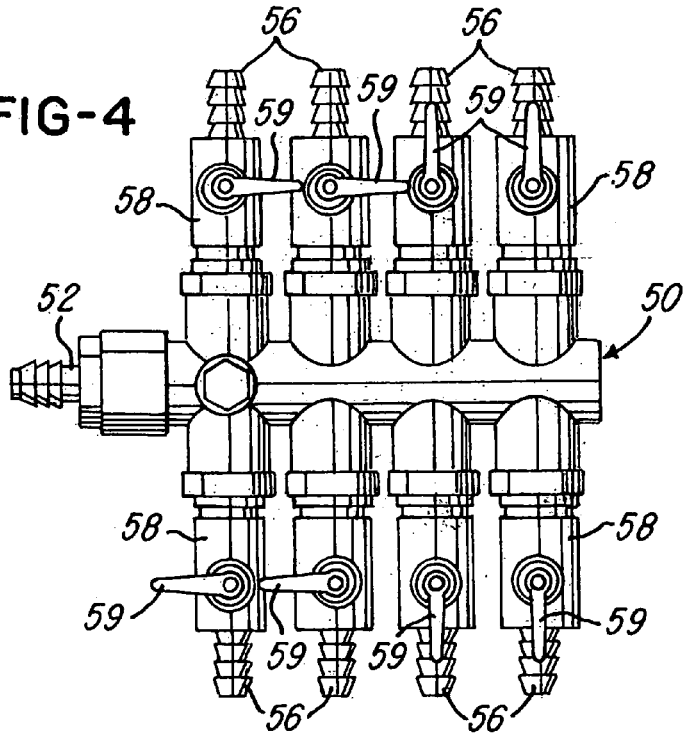
FIG. 4 is an enlarged perspective view of the manifold with on-off valves shown in FIG. 3 and diagrammatically shown in FIG. 2.

As shown in FIG. 2, the cleaning solution supply line 45 preferably includes a manifold 50 (FIGS. 2-4) which has an inlet 52 connected to the clear plastic flexible tube forming the first end portion 46 of the supply line 45. The manifold 50 also has a plurality of eight outlets 56 each having a ball valve 58 manually actuated by a lever 59 moveable through 90° between a closed position and an open position. The cleaning solution supply line 45 also includes a second end portion 66, preferably in the form of a clear plastic flexible tube, and connected to each of the outlets 56. A molded plastic adapter 70 is attached to each tube forming the second end portion 66 of the cleaning solution supply line 45, and each adapter 70 is constructed similar to the spout 22 or 42 but without an internal valve. The adapter 70 connects each of the second end portion or tube 66 to the coupler 32 forming part of the beverage supply line 25, and the adapter 70 is effective to open the valve within the coupler 32. For simplicity, the manifold 50 is illustrated in FIG. 2 for cleaning the four beverage supply lines 25 shown in FIG. 1. However, the manifold 50 may be used for cleaning more beverage supply lines by using more of the eight outlets 56 of the manifold 50. The manifold 50 may also be used for cleaning only one beverage supply line 25, simply by closing all of the valves 58 except for the one valve connected to the beverage supply line by the corresponding adapter 70.

The cleaning system of the invention is used simply by connecting the coupler 48 to the spout 42 projecting from the bag 35 enclosing the cleaning solution. One or more couplers 32 are then disconnected from the corresponding spouts 22 on the beverage supply bags 8, and each removed coupler 32 is connected to one of the adapters 70. The corresponding valve or valves 58 are then opened so that the cleaning solution is free to flow through the cleaning solution supply line 45 and then through each selected beverage supply line 25. When the dispensing valve 18 for each corresponding supply line 25 is opened, the cleaning solution is pumped to the valve 18 by the corresponding pump 30. After the clear cleaning solution flows from the dispensing valve 18 for a short period of time, this provides a visual indication that the corresponding beverage supply line 25 has been cleaned, and the dispensing valve 18 is closed. This procedure is repeated for each of the supply lines 25 until all of the selected beverage supply lines are cleaned. Each of the couplers 32 is then disconnected from its corresponding adapter 70 and reconnected to the spout 22 of a bag 8 for a new bag-in-box beverage. The corresponding dispensing valve 18 is then opened until the new beverage with color displaces the clear cleaning solution and flows from the dispensing valve 18. This procedure is repeated for each of the beverage supply lines 25.

From the drawings and the above description, it is apparent that a cleaning system constructed and used in accordance with the present invention, provides desirable features and advantages For example, by using a collapsible bag 35 for a prepared cleaning solution and supplying the cleaning solution through the cleaning solution supply line 45, a beverage supply line 25 is cleaned with a closed system so that no external contaminants may enter the beverage supply line 25 during cleaning. In addition, each beverage supply line 25, including the coupler 32, tubes 28, pump 30 and valve 18 and the corresponding connecting passage or conduit within the beverage dispenser 15 may be quickly and efficiently cleaned so that all beverage residue is removed from these components. As another feature, the manifold 50 provides for selectively or simultaneously cleaning a plurality or multiple beverage supply lines 25 simply by opening the corresponding manifold valves 58 connected to the beverage supply lines 25 and selectively or simultaneously opening all of the dispensing valves 18. Moreover, by prepackaging the cleaning solution in the collapsible bag 35, the precise predetermined formulation of the cleaning solution remains uniform and sanitary and is not mixed in an open bucket with the chance of different concentrations.

While the method and form of cleaning system herein described constitutes a preferred embodiment of the invention, it is to be understood that the invention is not limited to the precise method and system described, and that changes may be made therein without departing from the scope and spirit of the invention as defined in the appended claims.

What is claimed is:

1. A cleaning system for cleaning a beverage supply line extending from a collapsible beverage bag enclosed within a box to a beverage dispenser having a dispensing valve, said beverage bag having a spout with a shut-off valve, said beverage supply line having a coupler removably connected to said spout on said beverage bag and having a shut-off valve, said cleaning system comprising a box enclosing a collapsible cleaning solution bag containing a liquid cleaning solution, said cleaning solution bag having a spout with a shut-off valve, a cleaning solution supply line having a first end portion and a second end portion, said cleaning solution supply line including a manifold having an inlet and a plurality of outlets each having a shut-off valve, said inlet of said manifold connected to said first end portion of said cleaning solution supply line, said first end portion of said cleaning solution supply line removably connected to said spout on said cleaning solution bag, at least one of said outlets connected to said second end portion of said cleaning solution supply line, and said second end portion of said cleaning solution supply line removably connected to said coupler on said beverage supply line.

2. A cleaning system as defined in claim 1 and including a plurality of said beverage bags enclosed within corresponding boxes, a plurality of said beverage supply lines extending from corresponding said beverage bags to said beverage dispenser having a corresponding plurality of said dispensing valves, and a corresponding plurality of said cleaning solution supply lines connecting said outlets of said manifold to corresponding couplers on said beverage supply lines.

3. A cleaning system for cleaning a beverage supply line extending from a collapsible beverage bag enclosed within a box to a beverage dispenser having a dispensing valve, said beverage bag having a spout with a shut-off valve, said beverage supply line having a coupler removably connected to said spout on said beverage bag and having a shut-off valve, said cleaning system comprising a box enclosing a collapsible cleaning solution bag containing a liquid cleaning solution, said cleaning solution bag having a spout with a shut-off valve, a cleaning solution supply line having a first end portion and a second end portion, said first end portion of said cleaning solution supply line removably connected to said spout on said cleaning solution bag, said second end portion of said cleaning solution supply line removably connected to said coupler on said beverage supply line, an adapter attached to said second end portion of said cleaning solution supply line and removably connected to said coupler on said beverage supply line, and said adapter is effective to open said shut-off valve within said coupler on said beverage supply line.

4. A cleaning system as defined in claim 3 wherein said first and second end portions of said cleaning solution supply line comprise clear and flexible plastic tubing.

5. A cleaning system as defined in claim 3 and including a second coupler having a shut-off valve and removably connecting said first end portion of said cleaning solution supply line to said spout on said cleaning solution bag.

6. A cleaning system for cleaning a beverage supply line having a pump and extending from a collapsible beverage bag enclosed within a box to a beverage dispenser having a dispensing valve, said beverage bag having a spout with a shut-off valve, said beverage supply line having a coupler removably connected to said spout on said beverage bag and having a shut-off valve, said cleaning system comprising a box enclosing a collapsible cleaning solution bag containing a liquid cleaning solution, said cleaning solution bag having a spout with a shut-off valve, a cleaning solution supply line having a first end portion and a second end portion, said cleaning solution supply line including a manifold having an inlet and a plurality of outlets each having a shut-off valve, said inlet of said manifold connected to said first end portion of said cleaning solution supply line, a coupler removably connecting said first end portion of said cleaning solution supply line to said spout on said cleaning solution bag, at least one of said outlets connected to said second end portion of said cleaning solution supply line, and said second end portion of said cleaning solution supply line removably connected to said coupler on said beverage supply line.

7. A cleaning system as defined in claim 6 and including a plurality of said beverage bags enclosed within corresponding boxes, a plurality of said beverage supply lines extending from corresponding said beverage bags to said beverage dispenser having a corresponding plurality of said dispensing valves, and a corresponding plurality of said second end portions of said cleaning solution supply lines connecting said outlets of said manifold to corresponding said couplers on said beverage supply lines.

* * * * *